United States Patent [19]

Saito et al.

[11] 4,369,027

[45] Jan. 18, 1983

[54] LIQUID FUEL COMBUSTION APPARATUS

[75] Inventors: Toshihiko Saito, Yokohama; Katsuyoshi Kumazawa, Kawasaki; Moriyoshi Sakamoto, Yokohama, all of Japan

[73] Assignee: Tokyo Shibaura Denki Kabushiki Kaisha, Tokyo, Japan

[21] Appl. No.: 58,161

[22] Filed: Jul. 17, 1979

[30] Foreign Application Priority Data

| | | | |
|---|---|---|---|
| Jul. 19, 1978 | [JP] | Japan | 53-88123 |
| Jul. 19, 1978 | [JP] | Japan | 53-88125 |
| Aug. 31, 1978 | [JP] | Japan | 53-106672 |
| Nov. 14, 1978 | [JP] | Japan | 53-140041 |
| Dec. 8, 1978 | [JP] | Japan | 53-151717 |

[51] Int. Cl.[3] ..... F23D 5/02

[52] U.S. Cl. ..... 431/333; 431/261; 431/352; 431/350

[58] Field of Search ..... 431/352, 260, 261, 262, 431/218, 243, 331, 341, 201, 200, 350; 126/110 B, 333, 337

[56] References Cited

U.S. PATENT DOCUMENTS

| | | | |
|---|---|---|---|
| 2,409,677 | 10/1946 | Grotenhouse | 431/333 |
| 2,422,653 | 6/1947 | Breese et al. | 431/333 |
| 2,520,159 | 8/1950 | Long | 431/333 |
| 2,587,361 | 2/1952 | Miller | 431/333 |
| 2,757,662 | 8/1956 | Baier et al. | 126/110 B |
| 3,028,908 | 4/1962 | Brola | 431/168 |
| 3,713,433 | 1/1973 | Grainger | 431/352 |
| 3,816,055 | 6/1974 | Lear | 431/347 |
| 3,881,863 | 5/1975 | Creuz | 431/347 |
| 3,986,815 | 10/1976 | Miyahara | 431/168 |

FOREIGN PATENT DOCUMENTS

| | | | |
|---|---|---|---|
| 45-20366 | 6/1970 | Japan . | |
| 48-9240 | 7/1973 | Japan . | |
| 39495 | 6/1936 | Netherlands | 431/333 |

OTHER PUBLICATIONS

A.W. Hussman & G. W. Maybach, "The Film Vaporization Combustor" SAE Trans. No. 69 (1961), p. 563.

*Primary Examiner*—Carroll B. Dority, Jr.
*Attorney, Agent, or Firm*—Stevens, Davis, Miller & Mosher

[57] ABSTRACT

In a liquid fuel combustion apparatus having a horizontal combustion cylinder including a peripheral wall provided with perforations through which air is supplied in the form of jets. A fuel supplying system includes a fuel reservoir provided at the lowermost portion of the combustion cylinder. Vaporized fuel is mixed with the air jets and is subsequently burnt as it is carried horizontally.

5 Claims, 18 Drawing Figures

LIQUID FUEL COMBUSTION APPARATUS

BACKGROUND OF THE INVENTION

The present invention relates to a liquid fuel combustion apparatus, and more particularly to a liquid fuel combustion apparatus in which liquid fuel is vaporized and burned in a combustion cylinder.

A conventional combustion apparatus of this type, called a pot-type burner has a liquid fuel reservoir at the bottom of a vertical combustion cylinder. The fuel is vaporized from the fuel reservoir, and the vaporized fuel ascends by natural convection, while air is supplied through perforations in the peripheral wall of the combustion cylinder. Thus, diffusion burning is achieved, with the region of diffusion combustion extending from the bottom toward the top of the combustion cylinder. In this conventional apparatus, combustion takes place in coincidence with mixing of the vaporized fuel and the air. Actual excess air ratio is less than 1 in the lower part of the combustion cylinder, and the flame is elongated upwards. The temperature of the combustion gas is increased gradually, and at the top part of the combustion cylinder, actual excess air ratio is more than 1 and stable, smoke free, blue flame combustion is accomplished.

With this conventional apparatus, heat input or combustion rate can be adjusted over a wide range with the condition of constant airflow rate. However, a disadvantage of the apparatus is that it is relatively high because the combustion cylinder is set vertically and the flame is vertically elongated. This is particularly inconvenient when the combustion apparatus is incorporated in a heating apparatus such as space heater, and more particularly the heating apparatus is combined with an airconditioner.

Another type of conventional combustion apparatus has a horizontal combustion cylinder with a fuel reservoir in the center of the combustion cylinder in the vicinity of an end enclosed by an end plate. This apparatus has reduced height. However, since the fuel reservoir is positioned in the center of the cylinder, vaporized fuel concentration is higher in the upper portion of the combustion cylinder and lower in the lower portion, with the result that symmetry of combustion with reference to the axis of the combustion cylinder is lost. Also, the fuel reservoir is situated in the center of the combustion cylinder where the heat radiation from the flame is intensive. Accordingly, the liquid fuel in the fuel reservoir is subject to thermal decomposition producing combustion deposit in the fuel reservoir, and an ignition heater which is disposed to project into the fuel reservoir must be made of highly heat resistant materials. Furthermore, the fuel reservoir has to be accurately mounted to prevent the liquid fuel from spilling. And, even if the fuel reservoir is accurately mounted, there is a potential danger of spill of the liquid fuel, for instance, when the apparatus is vibrated.

SUMMARY OF THE INVENTION

An object of the invention is to provide a novel liquid fuel combustion apparatus in which fuel vapor vaporized from the fuel reservoir is carried by air introduced into the combustion cylinder and moved in a horizontal direction as it is burned.

Another object of the invention is to provide a liquid fuel combustion apparatus in which heat input can be varied over a wide range, without changing airflow rate.

Another object of the invention is to provide a liquid fuel combustion apparatus in which blue flame combustion is ensured even when heat input is very low.

Another object of the invention is to reduce the time for ignition in a liquid fuel combustion apparatus.

Another object of the invention is to reduce the time for fire extinguishment in a liquid fuel combustion apparatus.

Another object of the invention is to ensure stable combustion in a liquid fuel combustion apparatus even when fuel supply rate or airflow is fluctuated.

A further object of the invention is to reduce the height of a liquid fuel combustion apparatus, which is convenient when combined with other air conditioning apparatus because the assembly becomes compact.

A further object of the invention is to obtain the flame developed symmetrically about the axis of a combustion cylinder of a liquid fuel combustion apparatus.

According to the invention, there is provided a liquid fuel combustion apparatus having a horizontal combustion cylinder including a peripheral wall provided with perforations and an end plate for closing one end of the combustion cylinder, the other end of the combustion cylinder being open, a fuel supplying device for supplying liquid fuel into the combustion cylinder, and an air supplying device for supplying air into the combustion cylinder through the perforations, characterized in that the liquid fuel supplying device comprises a fuel reservoir at the lowermost portion of the combustion cylinder in the vicinity of the end plate, whereby an air stream is established in substantially horizontal direction from the end plate toward the open end and the fuel vapor vaporized from the fuel reservoir is burnt while it is carried by the air stream.

DESCRIPTION OF THE DRAWINGS

In the accompanying drawings: -

DESCRIPTION OF THE PREFERRED EMBODIMENTS

Figure 1:
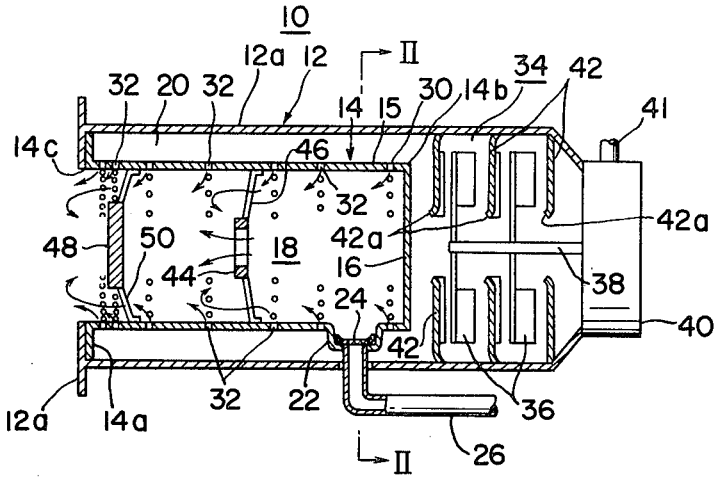
FIG. 1 is a longitudinal sectional view of an embodiment of a liquid fuel combustion apparatus according to the invention.

Referring now more particularly to FIG. 1, there is shown a liquid fuel combustion apparatus 10 according to an embodiment of the invention. The combustion apparatus 10 includes a housing 12, in which a combustion cylinder 14 is enclosed. The combustion cylinder 14 includes a peripheral wall 15. As illustrated, the combustion cylinder 14 is so disposed that its axis extends in a substantially horizontal direction. The right end of the combustion cylinder 14 is closed by an end plate 16, which may be formed integrally with the peripheral wall 15, while the left end is open, and a combustion chamber 18 is formed inside the combustion cylinder 14.

The left end of the combustion cylinder 14 is provided with a flange 14*a* which is engaged with a flange 12*a* provided at the left end of the housing to close one end of an annulus space for conducting air stream 20 formed between the combustion cylinder 14 and the housing 12.

A fuel reservoir 22 which also constitutes a heating surface is provided at the lowermost portion of the combustion cylinder 14 in the vicinity of the end plate 16. The fuel reservoir 22, in the illustrated embodiment, is formed by denting downward the lowermost part of the peripheral wall 15 of the combustion cylinder 14. A wick 24 is placed in the fuel reservoir 22 and a fuel supply pipe 26 is connected to the fuel reservoir 22 to convey liquid fuel such as kerosine to the fuel reservoir 22.

A plurality of primary air perforations 30 are provided in the peripheral wall 15 at the portion on the upstream side of the fuel reservoir 22. A plurality of secondary air perforations 32 are provided in the peripheral wall 15 at the portion on the downstream side of the fuel reservoir 22.

The cylindrical wall 12*a* of the housing 12 extends rearward, to the right beyond the end plate 16 to form a blower chamber 34, in which a pair of blower fans 36 are coaxially arranged. The blower fans 36 are coupled by a shaft 38 to an electric motor 40. Three partition walls 42 are provided on the left and right sides and between the fans 36. Air is introduced into the blower chamber 34 through an intake pipe 41 penetrating the casing of the electric motor 40. The partition walls 42 have their outer edge fixed to the housing 12, and an aperture 42*a* is provided in the center of each partition wall 42, so that pressure of the air is increased before the air is fed into the annulus space 20.

An annular flame holder 44 is positioned midway between the fuel reservoir 24 and the downstream end 14*c* of the combustion cylinder 14. The annular flame holder 44 is supported by radially extending supporting rods 46 fixed to the peripheral wall 15. A disc-shaped flame holder 48 is positioned near the downstream end 14*c* of the combustion cylinder 14. The disc-shaped flame holder 48 is also supported by radially extending supporting rods 50 fixed to the peripheral wall 15.

Figure 2:
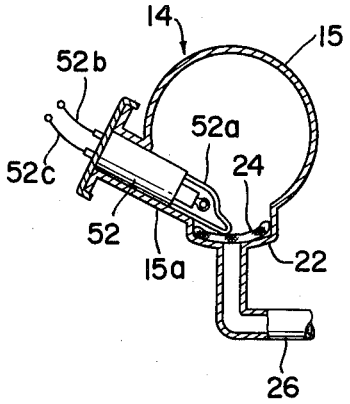
FIG. 2 is a cross-sectional view taken along the line II—II in FIG. 1.

As illustrated in FIG. 2, an ignition heater 52 is inserted through a bushing 15*a* formed in the peripheral wall 15 at a side portion near the fuel reservoir 22. The ignition heater 52 includes a metal wick portion 52*a* projecting into the fuel reservoir 22. The ignition heater 52 is provided with a pair of electrical leads 52*b* and 52*c* which are connected to an electrical power source, not shown. The ignition heater 52 may, for instance, have an output power of 50 W.

As the electric motor 40 is energized, the blower fans 36 are rotated, and hence compressed air is fed to the annulus space 20, and then flows through the primary air perforations 30 and the secondary air perforations 32 into the combustion chamber 18 in jets having a high dynamic pressure. The air thus introduced into the combustion chamber 18 forms a stream generally flowing toward the open end 14*c* of the combustion cylinder 14.

The movement of the air and reaction between the air and the fuel are detailed below. The perforations 30 and 32 are sized and distributed in a manner described later. The air flows into the combustion chamber 18 in high speed jets with a high dynamic pressure. The air jets are directed radially inwards. A negative pressure region is formed around each of the air jets. The fuel vapor ascending from the fuel reservoir 22 is pulled along with or entrained by the air jets and mixed. If the fuel concentration in each jet is within the inflammable range, combustion takes place and the resultant combustion gas flows toward the axis of the combustion cylinder 14. If combustion does not take place because of excessive fuel concentration, mixture of the fuel and the air flows toward the axis of the combustion cylinder. Thus gaseous streams converge on the axis of the combustion cylinder, and form a stream flowing generally along the axis of the combustion cylinder, and the region in which combustion occurs extends along the axis of the combustion cylinder over a wide range. Where the fuel concentration in the jets is excessive in the region above the fuel reservoir 22 combustion does not occur there and combustible mixture is moved downward, and is entrained by the air jets at the downstream side. And if the fuel concentration is suitable there, combustion takes place.

In the preferred embodiment, the perforations 30 and 32 are 1 mm in diameter. The delivery pressure of the blower fans 36 is 30 to 40 mmAq. The maximum heat input is designed to be 4,400 Kcal/h, and the actual excess air ratio is selected to be approximately 1.3. The velocity of the air jets through the perforations 30 and 32 is about 10 m/sec. The jet velocity is reduced as jets approach the center of the combustion chamber.

When combustion is initiated, the ignition heater 52 is energized, so that the liquid fuel sucked by capillary action of the metal wick 52*a* is heated and vaporized. The vaporized fuel is then mixed with the primary air injected through the primary air perforations 30, and is ignited by the heat of the ignition heater 52. The resultant flame extends over the surface of the liquid fuel in the fuel reservoir.

Figure 3:
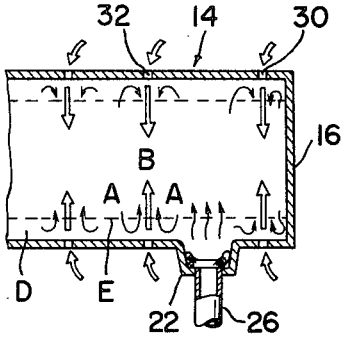
FIG. 3 is a schematic illustration of the flow of the air and the vaporized fuel in the combustion cylinder of the apparatus shown in FIG. 1.
Figure 4:
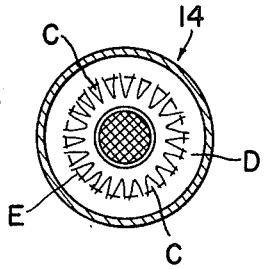
FIG. 4 is an end view of the combustion cylinder illustrating how the flames are formed.

The heat emanating from the flame promotes the vaporization of the fuel from the liquid surface. The fuel vapor ascending from the liquid surface is mixed with the air as it is conveyed and directed by the air stream along the axis of the combustion cylinder 14 toward the open end 14*c*. The fuel concentration in the mixture is decreased toward the downstream. As the fuel vapor flows through the zone where the secondary air perforations 32 are provided the air jets from the perforations 32 entrain, as indicated by arrows A, the fuel vapor so that jets of mixture B are obtained. If, at this moment, the mixture has suitable fuel concentration, blue flames C with excess air ratio of more than 1, are formed on the extensions of the air jets at a point at which the velocity of the jets is in balance with the burning velocity of the combustible mixture. As a result, flames C are formed inside a hypothetical cylinder E (indicated by dotted lines) as if there was a cylindrical flame port having the shape of the hypothetical cylinder E and having an arrangement of perforations similar to that of the combustion cylinder. In FIGS. 3 and 4, premixed zone where premixing occurs is indicated by reference symbol D.

Generally, blue flame combustion is enabled where (1) gaseous particles of fuel vapor are sufficiently small and uniform in size, (2) fuel vapors and air are mixed before they enter the combustion zone, (fuel vapor and air are kept below the cracking temperature before they enter the combustion zone).

It is considered if the size of the particles of the fuel vapor is less than 10 microns gaseous combustion or blue flame combustion is ensured. When liquid fuel is vaporized by heat of an ignition heater or heat radiated from the flame, the resultant particles in the fuel vapor will have the size of less than several microns. Therefore, the combustion apparatus of the invention satisfies the condition (1) above.

However, if the air is insufficient (even if the above-mentioned condition (1) is satisfied) thermal decomposition occurs in the vapor phase so that yellow flame and soot formation result. It is therefore necessary to form a homogeneous mixture before the fuel and the air enter the combustion zone or reaction zone, at a temperature sufficiently low to avoid thermal decomposition.

A conventional technique to thoroughly premix the fuel and the air before their entry into the reaction zone is to use a flame port to physically separate the premixed zone and the reaction zone. But in the type of combustion apparatus employing a flame port, wide range of heat input variation cannot be obtained. According to the invention, high velocity air jets entrain the fuel vapor to a mixture evenly mixed with an excess air ratio of more than 1.

It has been also found that even mixture of fuel and sufficient air is achieved in the premixed zone which extends up to the point at which the air jet velocity and the burning velocity of mixture are in equilibrium, by having air jets flow through perforations of 1 mm in size and at the initial velocity of about 10 m/sec. Thus, the apparatus according to the invention satisfies both of the conditions (1) and (2) mentioned above and ensures blue flame combustion.

Although the diameter of the perforation is in the embodiment illustrated, 1 mm, perforation with any size between 0.5 mm and 1.5 mm are also satisfactory. That is, combined with other features of the invention, premixed zone is formed and stable blue flame combustion is ensured. If the perforations have excessive size, entrainment of the fuel is insufficient, so that premixed zone is not formed, resulting in yellow flames. If the size of the perforation is too small, air jet velocity exceeds the burning velocity so that blow-off tends to occur and stability of the flames is lost.

Also, the delivery pressure of the blower fan is not limited to the range of 30–40 mmAg, but it can be varied within the range of 20–70 mmAg, depending on the configuration of the passage of the air and the required velocity of the air jets.

When viewed from the open end 14*c* of the combustion chamber 14 according to the invention, each flame extends in a radial direction as illustrated in FIG. 4. At the beginning of combustion, the vaporizing rate from the fuel reservoir 22 is relatively low, so that flames are mainly formed in the upstream zone of the combustion chamber 18. As the combustion chamber 18 is heated, the rate of vaporization is gradually increased, so that fuel concentration above the fuel reservoir is increased and the region in which flames are formed extends toward the downstream end 14*c*. In this situation, fuel vapor in the combustion chamber moves substantially in horizontal direction from the upstream end to the downstream end, and flames with excess air ratio of more than 1 are formed extensively over a wide range in the horizontal direction, enabling achievement of the maximum heat input.

Assume that the heat input is to be at 4400 Kcal/h for "high heat input", at 2300 Kcal/h for "middle heat input", and at 850 kcal/h for "low heat input", and kerosene is used as a fuel. In such a case, rates of fuel supply for the "high", "middle" and "low" heat inputs are respectively 0.535 l/h, 0.2796 l/h, and 0.1034 l/h. Theoretically, air necessary for the high rate combustion of 4400 Kcal/h is 4.88 $m^3$/h. However, when premixing is effected before the combustion, the actual air ratio needs to be about 1.3, so that an air quantity of $4.88 \times 1.3 \approx 6.4$ $m^3$/h is required. Accordingly, 245 perforations with the diameter of 1 mm are required for high heat input. For middle heat input, use of 165 perforations out of the 245 perforations is sufficient. For low heat input, use of 53 perforations out of the 245 perforations suffices.

Figure 5:
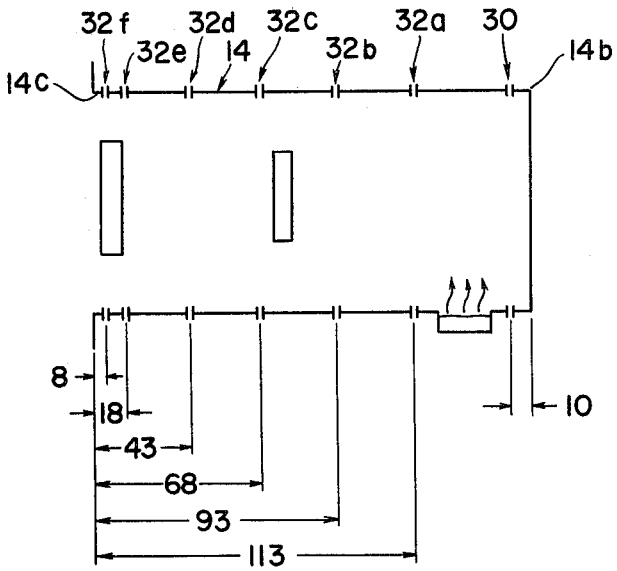
FIG. 5 is a schematic illustration showing an example of arrangement of perforations in the peripheral wall of the combustion cylinder.

An example of design of a combustion cylinder fulfilling such requirements is illustrated in FIG. 5. The illustrated combustion cylinder is 118 mm in diameter and is 190 mm long. The perforations are divided into seven rows, each row consisting of perforations aligned circumferentially and equally spaced from each other. The first row 30 is located on the upstream side of the fuel reservoir 22, 10 mm from the upstream end 14*b*, and consists of 12 perforations, constituting primary air perforations. The perforations of the second to seventh rows 32*a*–32*f* constitute the secondary air perforations. The second row 32*a* is located 113 mm from the open end 14*c* and consists of 25 perforations. The third row 32*b* is at 93 mm from the open end 14*c* and consists of 16 perforations. The fourth row is at 68 mm from the open end 14*c* and consists of 16 perforations. The fifth row 32*d* is at 43 mm from the open end 14*c* and consists of 16 perforations. The sixth and the seventh rows 32*e* and 32*f* are at 18 mm and 8 mm, respectively, from the open end 14*c* and each consists of 80 perforations. Thus, there are 245 perforations in total. The rate of air supply through the first row 30 is at 0.313 $m^3$/h. The rate of air supply through the second row 32*a* is at 0.653 $m^3$/h. The rate of air supply through each of the third to fifth rows 32b–32d is at 0.418 $m^3h$. The rate of air supply through each of the sixth and seventh rows 32e and 32f is at 2.09 $m^3/h$. The upper and the lower inflammability limits of the fuel concentration are 6.0% and 1.2%.

When kerosine is vaporized, the volume of the resultant vapor is about 220 times that of the original liquid. As mentioned above, the rate of fuel supply for "low heat input" is 0.1034 l/h, so that the rate of supply of fuel vapor is 22.7 l/h. Accordingly, the air supply rate corresponding to the lower inflammability limit is 1.869 $m^3/h$ and the air supply rate corresponding to the upper inflammability limit is 0.3556 $m^3/h$. Combustion is therefore completed by the air supplied through the first to third rows 30, 32a and 32b of the perforations.

For "middle heat input", the air supply rate corresponding to the lower inflammability limit is 5.066 $m^3/h$ and the air supply rate corresponding to the upper inflammability limit is 0.964 $m^3/h$, so that combustion is completed by the air supplied through the first to sixth rows of perforations.

For "high heat input", the air supply rate corresponding to the lower inflammability limit is 9.69 $m^3/h$ and the air supply rate corresponding to the upper inflammability limit is 1.344 $m^3/h$, with the result that the upper inflammability limit is exceeded in the region surrounded by the first to third rows 30, 32a and 32b, and combustion takes place in the region surrounded by the fourth to seventh rows 32c, 32d, 32e and 32f.

Figure 6:
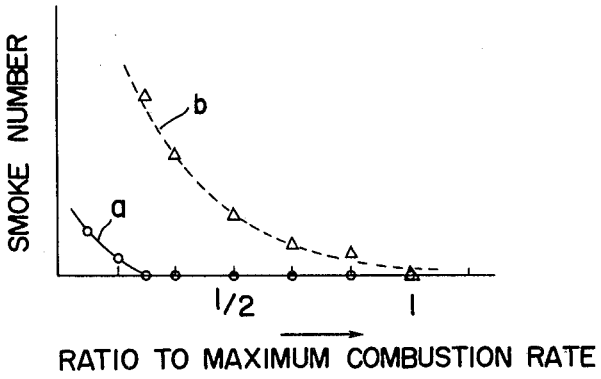
FIG. 6 is a graph showing a result of a comparison test of a combustion apparatus according to the invention with a conventional combustion apparatus.

An advantage of the invention over the conventional vertical pot-type combustion apparatus is seen from FIG. 6, in which the curve (a) shows the smoke number (Bacharach Index) in the exhaust gas in a combustion apparatus according to the invention, while the curve (b) shows the smoke number in the exhaust gas in a conventional apparatus. It will be understood that perfect blue flame combustion is achieved over the range of the maximum heat input (maximum combustion rate) to one quarter of the maximum heat input and combustion with smoke number of less than 1 is achieved down to one-sixth of the maximum heat input.

In the embodiment described above, the fuel reservoir 22 is formed by downwardly denting the lowermost portion of the combustion cylinder 14. Alternatively, the fuel reservoir may comprise the lowermost portion of an annular dent formed by radially outwardly denting the combustion cylinder. Still alternatively, the fuel reservoir may comprise the lowermost portion of an annular portion between a pair of annular protrusions formed by radially inwardly protruding the combustion cylinder.

Figure 7:
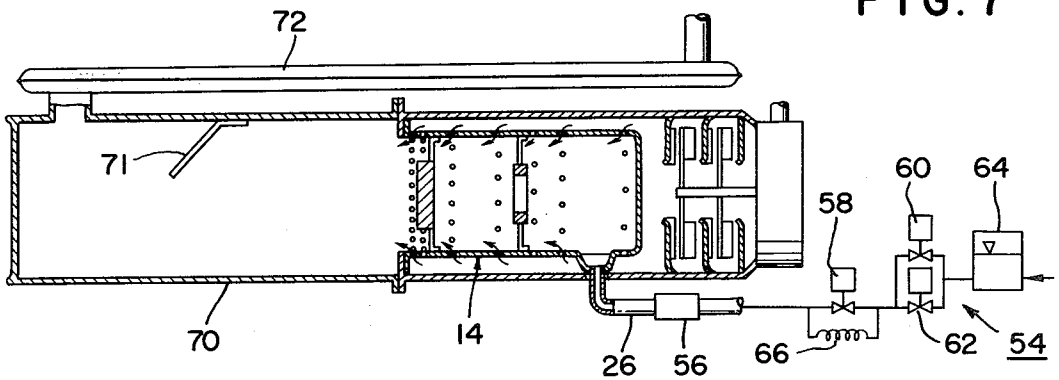
FIG. 7 is a longitudinal sectional view of the combustion apparatus of FIG. 1 assembled with a heat exchanger and a fuel supply system.

The combustion apparatus according to the invention may be associated with a fuel supply regulating device 54 and other devices as illustrated in FIG. 7. Provided in the middle of the fuel supply pipe 26 is a fire extinguishing device 56. At the end of the fuel supply pipe 26 is a solenoid valve 58, which in turn is connected to a pair of solenoid valves 60 and 62 connected in parallel with each other. The valves 60 and 62 are connected to an oil control valve 64 for controlling the liquid level in the fuel reservoir. The oil control valve 64 is supplied with fuel from a fuel tank not shown. The valve 58 is bypassed by a capillary tube 66.

For "high heat input", the valves 58, 60 and 62 are all open. For "middle heat input", the valve 58 and either of the valves 60 and 62 are open. For "low heat input", the valve 58 is closed and the fuel is supplied through the capillary tube 66. Thus, fuel supply rate is adjusted to produce the required heat input.

Thus, the blue flame combustion is ensured even when the heat input is very low, and heat input can be adjusted as desired to meet the specific requirement of the particular instant.

Let us now consider a situation where cold-start ignition is effected, i.e., where the combustion apparatus is ignited when it is not previously heated. At the beginning of combustion when the combustion cylinder is still cold, rate of vaporization of the fuel is low. As a result, combustion becomes intermittent, that is, vaporized fuel is all burned and combustion is interrupted until subsequent vaporization produces inflammable mixture, and such process is repeated. If a disc-shaped flame holder was used in place of the annular flame holder shown in FIG. 1, the tendency for the intermittent combustion would be enhanced because the disc-shaped flame holder has a high flow resistance obstructing the release of high pressure caused by the combustion. In contrast, the annular flame holder 44 has a low flow resistance permitting fast release of the high pressure and smooth flow of the combustion gas while reducing the undesirable reverse gas flow. Accordingly, transition from ignition to steady-state condition is quick.

As illustrated in FIG. 7, an additional combustion cylinder 70 is provided having one end connected to the open end of the combustion cylinder 14, to form a combustion gas conduit extending into the additional combustion cylinder 70. The other end of the additional combustion cylinder 70 is connected to a plate-type heat exchanger 72 to feed it with exhaust gas. A baffle plate 71 deflects the flow of the gas downward.

It will be appreciated that horizontal arrangement of the combustion cylinder 14 has an advantage in that the height of the combustion apparatus is reduced. This feature is particularly significant when the combustion apparatus is incorporated in a heating apparatus, and more particularly, when the heating apparatus is combined with an air conditioner.

Figure 8:
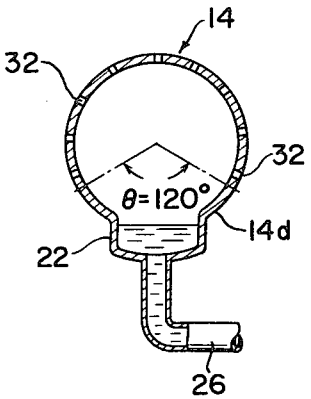
FIG. 8 is a cross-sectional view showing a modification of the combustion cylinder.

The above-mentioned combustion apparatus with perforations distributed throughout the peripheral wall ensures blue flame combustion even when heat input is very low. However, there is a lower limit of heat input because yellow flames are formed only above the fuel reservoir, and flames are not formed in the upper part of the combustion cylinder, i.e., extension of combustion region is not ensured. In expanding the range of heat input at which satisfactory combustion is achieved, and more particularly, in accomplishing satisfactory combustion at even lower heat input, it has been found that combustion cylinder having a portion 14d (see FIG. 8) surrounding the fuel reservoir in which no perforation is provided is effective. Such a portion 14d should, for example, extend rearward and foreward of the fuel reservoir and extend along the periphery over an arc subtending a central angle of 120°, for example, with the lowermost point of the combustion cylinder being included in that arc, as illustrated in FIG. 8. The arc may be reduced down to a point where the subtended central angle is 90°.

With decreased heat input, vaporized fuel from the fuel reservoir ascends. In the region corresponding to the combustion cylinder portion 14d without perforations, air is not sufficiently supplied so that fuel concentration exceeds the upper inflammability limit, so that combustion is difficult to occur. As the vaporized fuel ascends further and reaches the region where air jets exist, the fuel is mixed with the air and the fuel concentration falls within the inflammable range, so that blue flame combustion takes place.

Figure 9:
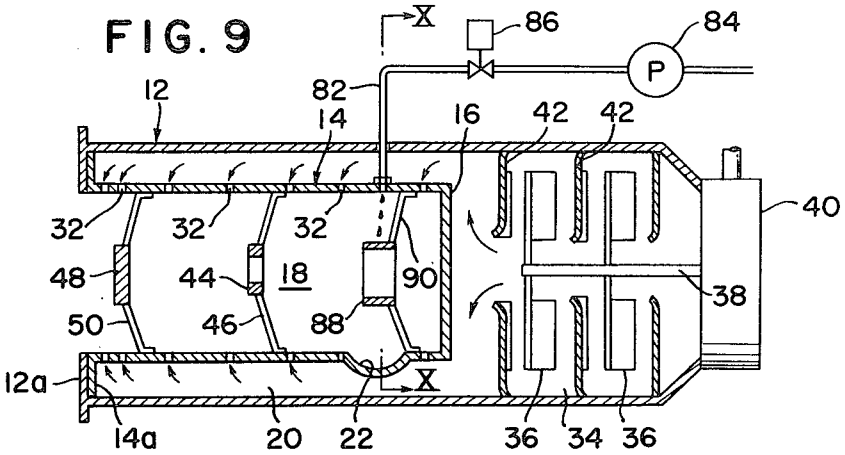
FIG. 9 is a longitudinal sectional view showing another embodiment of the liquid fuel combustion apparatus according to the invention.

FIG. 9 shows a different embodiment of the invention. The apparatus is generally identical to that shown in FIG. 1. However, the fuel supply pipe 26 in FIG. 1 is not provided, and instead a fuel supply pipe 82 is connected to a top portion of the combustion cylinder 14 right above the fuel reservoir 22. Provided in the middle of the fuel supply pipe 82 are a fuel supply pump 84 for feeding a liquid fuel and a fuel supply rate regulating valve 86 for adjusting or regulating the fuel supply rate.

Figure 10:
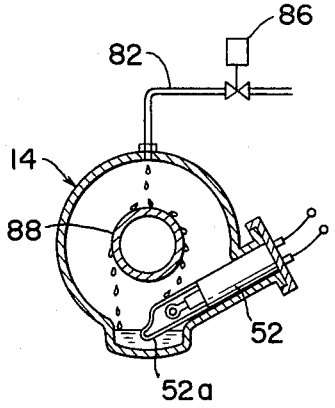
FIG. 10 is a cross-sectional view taken along the line X—X, in FIG. 9.

A dropping member in the form of a dropping ring 88 is positioned in the combustion chamber 18, coaxially with the combustion cylinder 14 and adjacent to the end plate 16, and is supported by a supporting member 90. The dropping ring 88 is thus located in such a position as to receive the droplets from the opening of the fuel supply pipe 82. The droplets received by the dropping ring are divided and flow along the periphery of the dropping ring, and then fall down towards the fuel reservoir 22, as illustrated in FIG. 10. The fuel thus falling into the fuel reservoir 22 is temporarily stored or reserved in the fuel reservoir 22. Part of the droplets from the dropping ring 88 directly fall onto the wick portion 52*a* of the ignition heater 52 to wet the wick portion 52*a*.

As the ignition heater 52 is energized, it is heated and part of the fuel is vaporized. The vaporized fuel is then mixed with the air injected through the perforations 30 and 32. The ignition thus takes place 10 to 15 seconds after the commencement of energization of the ignition heater 52. The resultant flame developed over the surface of the liquid fuel in the reservoir accelerates vaporization, and all the liquid fuel in the fuel reservoir 22 is vaporized several minutes later, i.e., the fuel reservoir 22 is emptied. When the state of steady combustion is established, the fuel droplets from the fuel supply pipe 82 are mostly vaporized before they reach the fuel reservoir 22, i.e., when they are in contact with the dropping ring which is heated by radiation from the flames. Therefore, liquid fuel is not stored in the fuel reservoir 22, unless the fuel supply rate is excessive.

In this embodiment, heat input can be varied by adjusting the fuel supply valve 86.

To extinguish the combustion apparatus, the fuel supply pump 84 is stopped, so that the supply of fuel droplets is terminated. The droplets already in the combustion chamber 18 are burned in a short time. Thus, fire extinguishment is completed in an instant.

Figure 11:
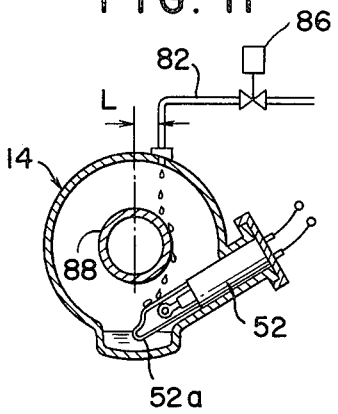
FIG. 11 is a cross-sectional view similar to FIG. 10, showing a modified manner in which the fuel supply pipe is mounted to the combustion cylinder.

In the embodiment mentioned above, the fuel supply pipe 82 is connected to the top portion of the combustion cylinder 22, i.e., exactly above the axis of the combustion cylinder 22. However, the position at which the pipe 82 is connected may be deviated from the position right above the axis of the combustion cylinder 22, by a distance L, as illustrated in FIG. 11, so that all the droplets from the fuel supply pipe 82 flow along one side of the dropping ring 88 and fall on the ignition heater 52. With such an arrangement, time required for ignition is further reduced.

Figure 12:
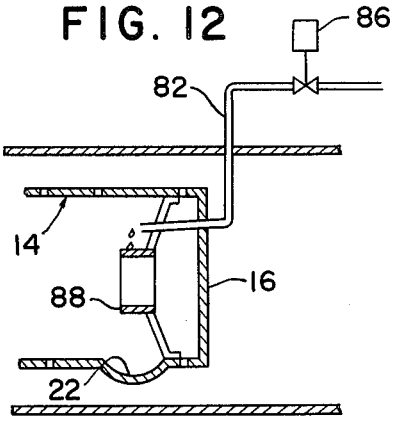
FIG. 12 is a longitudinal sectional view showing a further modification of the manner in which the fuel supply pipe is mounted.

The fuel supply pipe 82 is not necessarily connected to the peripheral wall 15 of the combustion cylinder 14, but may be made to extend through the end plate 16 into the combustion chamber 18 as illustrated in FIG. 12.

Figure 13:
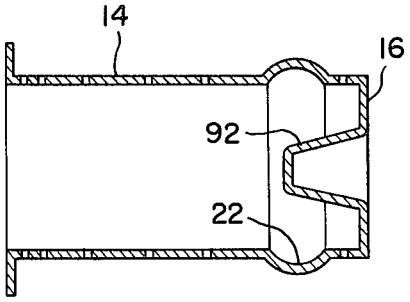
FIG. 13 is a longitudinal sectional view showing a modification of the dropping member.

FIG. 13 shows a modification of the dropping member 92 which may be used in substitution for the dropping ring 88 shown in FIGS. 9 and 10. The dropping member 92 is a truncated conic projection formed by inwardly denting the central part of the end plate 16. By forming the dropping member integrally with the end plate, the cost of production is substantially reduced.

It should be noted that the dropping member may be omitted. In such a case, the fuel supply pipe may be provided in such a manner that the droplets from the fuel supply pipe 82 fall directly to the fuel reservoir 22.

Figure 14:
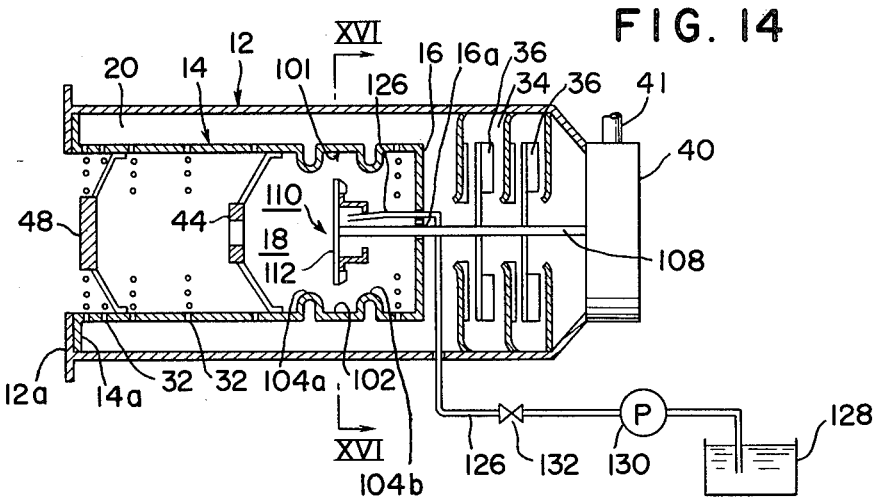
FIG. 14 is a longitudinal sectional view showing a further embodiment of the combustion apparatus according to the invention.

FIG. 14 shows a further embodiment of the invention. The combustion apparatus of this embodiment is substantially identical to that shown in FIG. 1, except as noted below. Instead of the fuel reservoir 22 formed by downwardly denting the lowermost portion of the combustion cylinder 14, a fuel reservoir 102 is formed by the lowermost portion 102 of an annular portion of the peripheral wall 15 of the combustion cylinder 14 between a pair of annular projections 104*a* and 104*b* formed inwardly deforming the peripheral wall 15 of the combustion cylinder 14. The annular portion 101 constitutes a vaporizing region on which the liquid fuel is vaporized.

Figure 16:
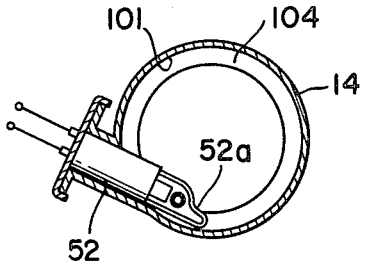
FIG. 16 is a cross-sectional view along the line XVI—XVI in FIG. 14.

As illustrated in FIG. 16, an ignition heater 52 is provided, with its wick portion 52 projecting into the fuel reservoir 102.

Figure 15:
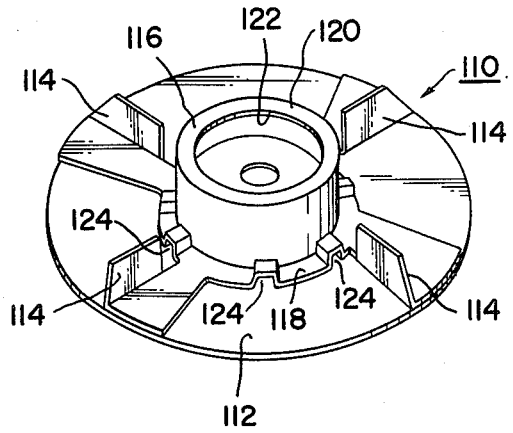
FIG. 15 is a perspective view of an example of a rotary atomizer incorporated in the combustion apparatus shown in FIG. 14.

In place of the shaft 38 shown in FIG. 1, there is provided a longer shaft 108 which extends through the end plate 16 into the vaporizing region. Mounted to the end of the shaft 108 is a rotating type atomizing device 110. The atomizing device 110 comprises, as is better illustrated in FIG. 15, a disc 112 attached to the end of the shaft 108. Fixed to the rear face of the disc 112 are four equally spaced blades 114, each of which extends in radial and axial directions. A cylindrical fuel reception member 116 is provided, having one end thereof attached to the central part of the rear face of the disc 112, by means of a flange 118. The other end of the cylindrical fuel reception member is provided with an inwardly extending annular portion 120 defining an opening 122. Several radial fuel passages 124 are provided by rearwardly deforming the flange 118 and cutting off the cylindrical fuel reception member.

A fuel supply pipe 126 extends through the end plate 16 to the fuel reception member 116. The fuel supply pipe 126 conveys liquid fuel from a fuel tank 128. A pump 130 for pressurizing the liquid fuel and a valve 132 for regulating the flow rate are provided on the fuel supply pipe 126.

As the rotating type atomizing device 110 is rotated, liquid fuel supplied to the fuel reception member 116 is subject to centrifugal force, and it therefore flows through the passages 124 and hit by the blades 114 to be scattered radially outward in droplet form. The scattered droplets collide with the annular portion 101.

Before the combustion apparatus is ignited, the peripheral wall is not heated, so that droplets colliding with the annular portion 101 are not immediately vaporized, but flow along the annular portion 101 down to the fuel reservoir 102.

For ignition, the heater 52 is energized to vaporize part of the liquid fuel in the fuel reservoir 102. The vaporized fuel is mixed with the air and is ignited by the aid of the heat from the heater 52. Ignition takes place 10–15 seconds after the commencement of energization of the heater 52. The resultant flame is formed over the surface of the liquid fuel. Heat emanating from the flame heats up the annular portion 101. Accordingly, the fuel droplets scattered from the atomizing device 110 are vaporized when they collide with the heated annular portion 101, or when they flow along the annular portion 101. The resultant particles of the fuel vapor are several microns or smaller in size. The fuel vapor is mixed with the air. The liquid fuel in the fuel reservoir 102 continues to be vaporized, and as a result, the fuel reservoir 102 is emptied about two minutes after the ignition.

Figure 17:
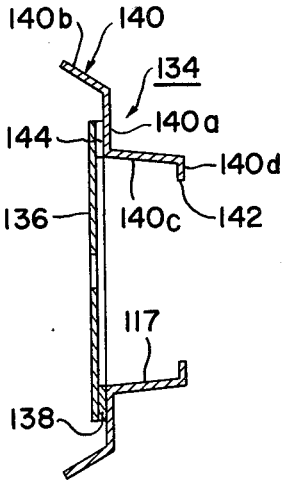
FIG. 17 is a sectional side view of a modification of the rotary atomizer.
Figure 18:
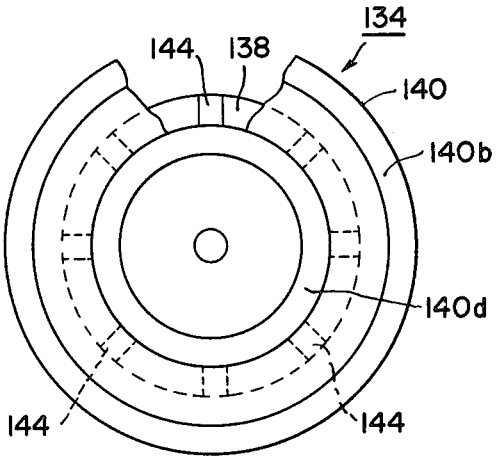
FIG. 18 is a rear view, partially broken, of the rotary atomizer shown in FIG. 17.

FIGS. 17 and 18 show a modification of a rotating type atomizing device 134. The atomizing device 134 comprises a disc 136 attached to the shaft 108. A distributer 140 is disposed coaxially with and fixed to the disc 136, with eight spacers 138 formed by deforming the disc 136 and interposed between the disc 136 and the distributer 140. The distributer 140 comprises an annular portion **140*a* whose inner edge is attached to the disc 136 by the spacers 138, and a first truncated conic portion 140*b* with its smaller diameter edge connected to the outer edge of the annular portion 140*a* and with its larger diameter edge situated on the downstream side of the smaller diameter edge so that the truncated conic portion 140*b* is open toward the downstream side. The distributer 140 also includes a second truncated conic portion 140*c* with its larger diameter edge connected to the inner edge of the annular portion 140 and with its smaller diameter edge situated on the upstream side of the larger diameter edge so that the second truncated conic portion 140*c* is closed toward the downstream. The smaller diameter portion 140*c* is provided with an inwardly extending portion 140*d*, whose inner edges define an opening 142. The second truncated conic portion 140*c* and the inwardly extending portion 140*d* form a fuel reception member. Eight passages 144 are formed between adjacent spacers 138 and between the disc 136 and the annular portion 140*a* of the distributor 140**.

Liquid fuel introduced into the fuel reception member 117 is, by the action of centrifugal force, conducted to the front or downstream face of the first truncated conic portion **140*b* and is dispersed toward the downstream. Accordingly, flame is established downstream of the atomizing device 134, so that it is possible to separate the flame from the atomizing device 134**.

Instead of forming a pair of annular projections **104*a* and 104*b*, one may form an annular dent in the combustion cylinder 14 so that the bottom portion of the annular dent constitutes the fuel reservoir and the annular dent constitutes a vaporizing region. Still alternatively, just a dent, similar to that shown in FIG. 9**, may be formed as a fuel reservoir.

As will be appreciated, use of an atomizing device enables symmetrical and uniform supply of fuel and hence symmetrical and uniform development of the flames.

In the embodiments shown in FIG. 9 and FIG. 14, the fuel reservoir is emptied after the beginning of combustion, so that fire extinguishment is achieved in an instant after the supply of fuel is stopped by deenergizing the pump.

What is claimed is:

1. A liquid fuel combustion apparatus, comprising:

a horizontal combustion cylinder having a peripheral wall and first and second ends;

an end plate for closing said first end of said combustion cylinder, said second end of said combustion cylinder being open;

fuel supplying means comprising a fuel reservoir located at the lowermost portion of said combustion cylinder in the vicinity of said end plate;

a first plurality of annularly-arranged perforations in said peripheral wall adjacent said fuel reservoir;

an angularly shaped first flame holder means spaced from the peripheral wall of said combustion cylinder and located intermediate the length of said combustion cylinder;

a second plurality of annularly-arranged perforations in said peripheral wall on the downstream side of said first flame holder means;

a disc shaped second flame holder means located adjacent said open second end of said combustion cylinder;

a third plurality of annularly-arranged perforations in said peripheral wall on the upstream side of said second flame holder means;

a fourth plurality of annularly-arranged perforations in said peripheral wall on the downstream side of said second flame holder means;

a housing enclosing said combustion cylinder, and being spaced from said cylinder to form an air stream conduction space between said cylinder and said housing; and air supply means comprising a blower for blowing compressed air into said air stream conduction space.

2. An apparatus as claimed in claim 1, wherein each of said perforations has a size between 0.5 mm and 1.5 mm.

3. An apparatus as claimed in claim 1, wherein the numbers of perforations in said first, second, third and fourth pluralities of perforations are such that the spatial frequency of said perforations is higher toward said open second end of said combustion cylinder.

4. An apparatus as claimed in claim 1, wherein said blower blows air into said conducting space at a pressure between 20 mm Aq and 70 mm Aq.

5. An apparatus as claimed in claim 1, wherein the peripheral wall of said combustion cylinder has an unperforated portion surrounding said fuel reservoir.

* * * * *